United States Patent [19]

Aiuola et al.

[11] Patent Number: 4,612,080

[45] Date of Patent: Sep. 16, 1986

[54] WEB SPLICING APPARATUS

[75] Inventors: Franco Aiuola, Bologna; Renato Piccinini, Sala Bolognesa, both of Italy

[73] Assignee: ACMA, Farmington, Conn.

[21] Appl. No.: 598,953

[22] Filed: Apr. 11, 1984

[30] Foreign Application Priority Data

May 3, 1983 [IT] Italy ..... 3407 A/83

[51] Int. Cl.[4] ..... B65H 19/08

[52] U.S. Cl. ..... 156/504; 156/505; 156/157; 242/56 R; 242/58.1; 242/58.3; 242/58.5

[58] Field of Search ..... 156/157, 159, 505, 502, 156/503, 504, 525; 242/56 R, 58.1, 58.3, 58.5; 83/215, 216, 217, 320, 553

[56] References Cited

U.S. PATENT DOCUMENTS 3,895,763 7/1975 Tokuno ..... 156/504
4,170,506 10/1979 Marschke ..... 156/159
4,481,053 11/1984 Tokuno et al. ..... 156/157

FOREIGN PATENT DOCUMENTS 265411 2/1966 Australia ..... 83/215

*Primary Examiner*—Jay H. Woo
*Assistant Examiner*—Timothy W. Heitbrink
*Attorney, Agent, or Firm*—Alan N. McCartney

[57] ABSTRACT

Apparatus for splicing the trailing end of an old web to a new web comprises a pair of tangential fixed rollers between which the old web is fed. At each side of the fixed rollers two further rollers are supported by arms pivotted on a pin lying in the tangent plane. The old web runs over one of these rollers, while on the other the starting end of the new web is supported with a double-sided adhesive tape thereon. The roller above which the old web runs is pivotted above the other roller so that the web runs between the rollers and the webs are spliced by raising the lower roller, as the old web runs out. A cutting device separates the tail of the old web. The upper roller is then moved back to its original position for preparing a new web.

5 Claims, 12 Drawing Figures

WEB SPLICING APPARATUS

FIELD OF THE INVENTION

This invention is concerned with apparatus for splicing the trailing end of a web which has just run out and the leading end of a new web.

BACKGROUND OF THE INVENTION

An established technique in the field of the above mentioned type of apparatus is based on the idea of feeding the web which has run out and the new one between a pair of rollers which are brought together so as to bring the first web into contact with the second thereby splicing them by putting a suitable adhesive between them. This adhesive is commonly provided by a transverse double-sided adhesive tape previously applied manually by an operator to the leading end of the new web. This double-sided adhesive tape is the source of considerable problems due to the fact that, as the area of contact of the rollers is usually inaccessible, it is necessary to make special provision for the tape to be applied to the web at a point which is convenient for the operator to carry out the necessary manipulation. Moreover the subsequent positioning of the end of the new web between the rollers requires special care inasmuch as there is a need to avoid the tape which has been applied to the new web becoming stuck to parts of the equipment when it is fed between the rollers, thereby making subsequent splicing impossible without replacing the tape. The above mentioned problems are made even worse when the webs are of any significant width, since in this case the web does not have much transverse rigidity and is inclined to bend.

OBJECTS OF THE INVENTION

One of the objects of this invention therefore is to provide apparatus which will substantially eliminate the problems discussed above, both as regards the application of the adhesive tape to the end of the new web, and as regards the positioning of the tape relative to the trailing end of the web which has just run out.

SUMMARY OF THE INVENTION

The above and other objects are achieved by providing apparatus for splicing the trailing end of a web of a reel which has just run out and the leading end of a web of a new reel in which the web is fed between a pair of fixed rollers generally tangential to one another, comprising a further two rollers parallel to the fixed rollers, each of these further rollers being supported by an associated pair of arms mounted for pivotal movement about a common axis lying substantially in the tangent plane of the aforesaid pair of fixed rollers so that the further rollers can be moved between positions of substantial complanation with the aforesaid pair of fixed rollers, in which the further rollers lie one at either side of the fixed rollers resting on cam mechanism, and positions of superposition (one such position at either side of the fixed rollers) in which one of the further rollers has been moved, by rotation about the aforesaid axis, above the other roller and locked at a pre-determined position spaced from the lower roller, with the trailing end of the web of the reel which has run out passing round the upper roller between the upper and lower rollers, the cam mechanism being operable to raise the lower roller and press it against the upper roller, whereby the leading end of the new web supported on the lower roller can be pressed against the trailing end of the old web with a layer of suitable adhesive between the webs to join the two webs.

Preferably apparatus according to the invention comprises a cutting device for trimming the tail from the trailing end of the old web. Conveniently the cutting device can be moved between non-operational and operational positions.

Preferably apparatus according to the invention comprises locking means, suitably including an obstacle comprising pins which engage the arms supporting the upper roller, for locking the upper roller in position, and means for releasing the locking means when it is desired to return the upper roller to its original position.

BRIEF DESCRIPTION OF THE DRAWINGS

There now follows a detailed description to be read with reference to the accompanying drawings of a web splicing apparatus embodying the invention. It will be realised that this apparatus has been selected for description to illustrate the invention by way of example.

In the accompanying drawings

DESCRIPTION OF THE PREFERRED EMBODIMENT

Figure 1:
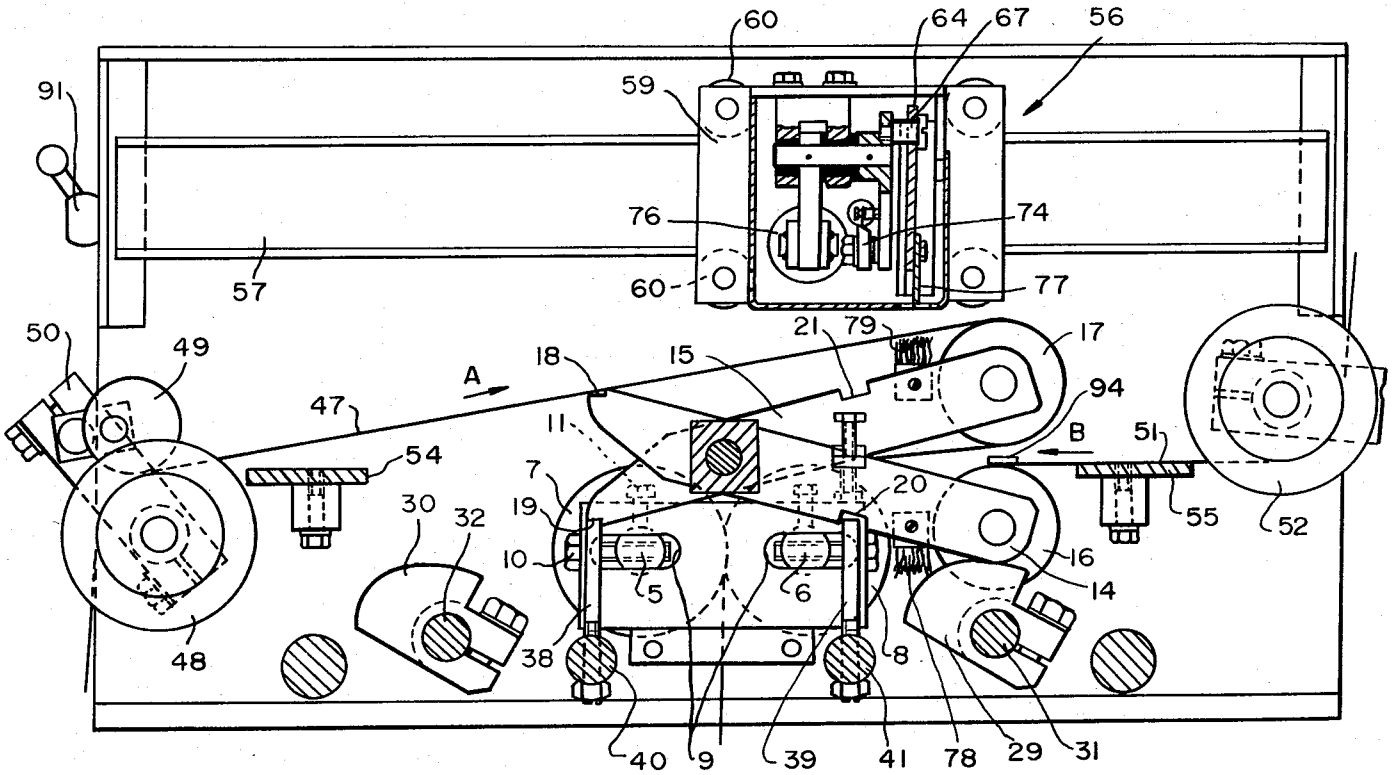
FIG. 1 is a front view of the apparatus in cross-section on the line I—I of FIG. 3.
Figure 2:
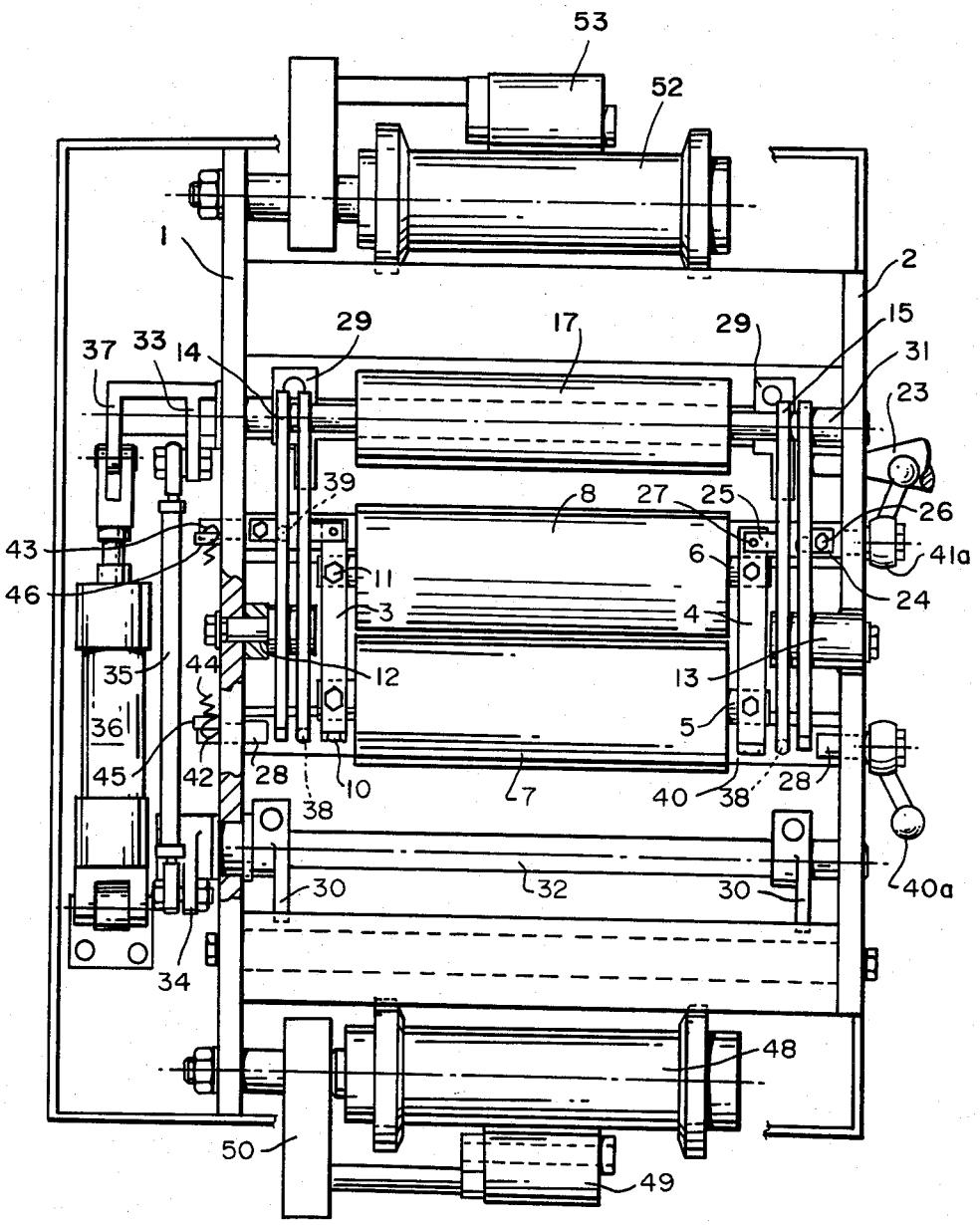
FIG. 2 is a plan view with some parts shown in cross-section.
Figure 3:
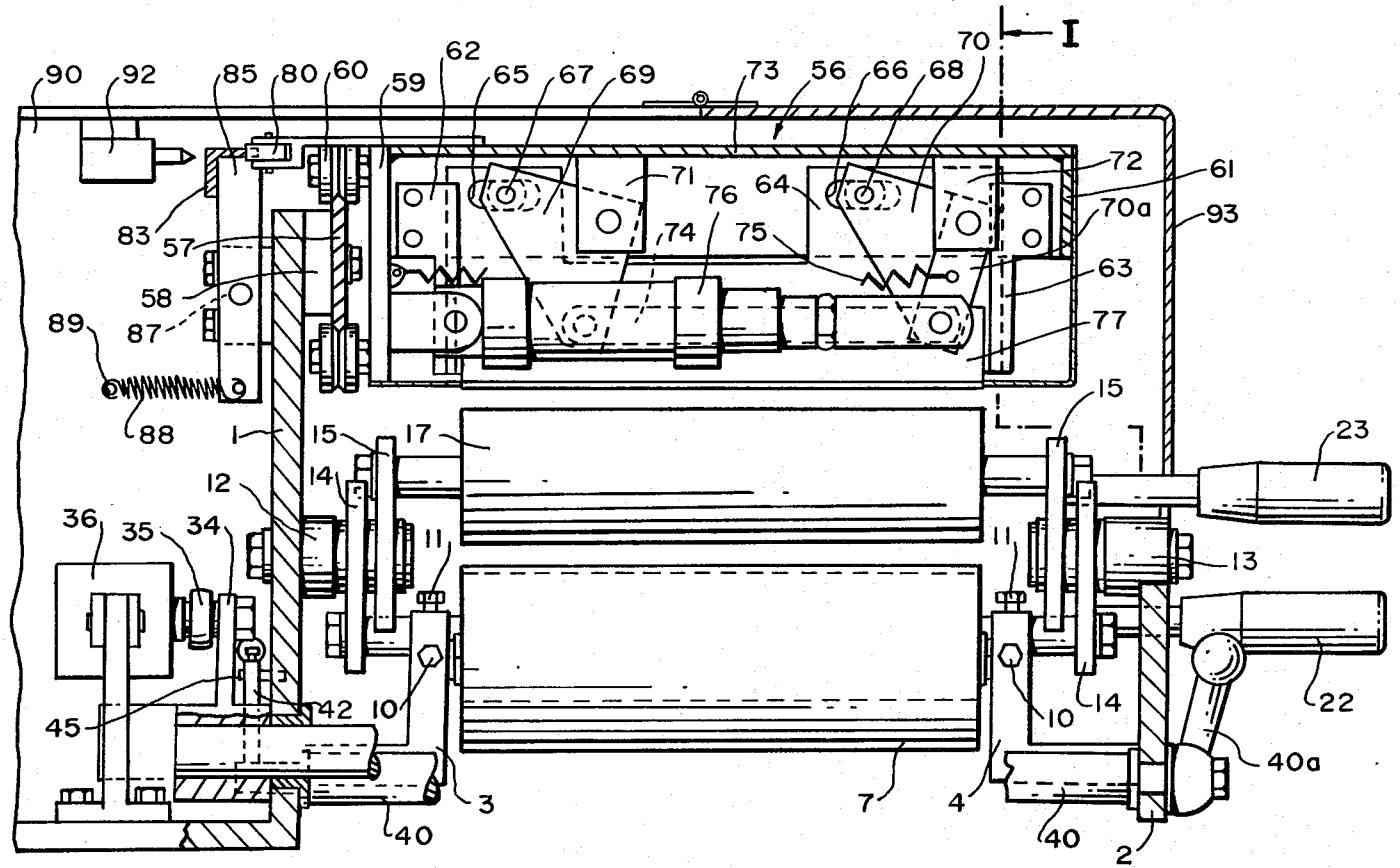
FIG. 3 is a side view with some parts shown in cross-section to highlight constructional components.

The illustrative web splicing apparatus comprises a frame having two parallel vertical walls 1, 2 (see FIGS. 2 and 3) the first of which is appreciably higher than the second. Projecting from the base of the walls 1, 2 and facing one another are two right angled brackets 3, 4, having two vertical portions by which are supported opposite ends of a pair of shafts 5, 6 which respectively support idler rollers 7, 8 which are substantially in tangential contact with one another (however with a small "nip" opening therebetween). As best seen in FIG. 1, the opposite ends of the shafts 5, 6 have flat portions above and below so that they can be inserted and slide in respective horizontal slots 9 in the vertical portions of the brackets 3, 4. Screws 10, passing through the ends of the shafts 5, 6 and with their heads abutting the vertical edges of the brackets 3, 4, enable the shafts 5, 6 to be moved with respect to each other along the slots 9 in order to adjust the relative positions of the rollers 7, 8 in which positions they are locked by screws 11 which act from above on the flat portions of the shafts 5, 6.

Integral with the walls 1, 2, in the vertical plane tangential to the rollers 7, 8, are two coaxial bushes 12, 13 in which are pivotted two pairs of rocker arms 14, 15 capable of swinging, about a common axis lying substantially in the tangent plane of the fixed rollers, in planes between the ends of the rollers 7, 8 and the adjacent walls 1, 2. The pair of rocker arms 14 is disposed outwardly of the pair of rocker arms 15 (i.e. adjacent the associated one of the walls 1, 2). The rocker arms each comprise one longer portion and one shorter one. Between the ends of the longer portions are supported idler rollers 16, 17. At the ends of the shorter portions are notches 18, 19, whilst further notches 20, 21 are formed in the edges of the longer portions near midpoints thereof.

Attached to the rocker arms adjacent to the wall 2, near the mounting points of the rollers 16, 17 are two handles 22, 23 which protrude from the front of the apparatus to facilitate access by the operator. By operating the handles 22, 23 the pairs of rocker arms 14, 15 can be rotated in the bushes 12, 13 so as to move the rollers 16, 17 to the right or to the left of the rollers 7, 8 (viewing FIG. 1). The pairs of rocker arms 14, 15 are provided externally and internally respectively with lugs 24, 25, into which are screwed adjusting screws 26 and 27. When the rollers 16, 17 are positioned in superposition to the right of the rollers 7, 8 (the position shown in FIG. 1) the screws 27 come to rest on the top of the brackets 3, 4; on the other hand when the rollers 16, 17 are positioned to the left of the rollers 7, 8 the screws 26 come to rest on the protrusions 28 which are presented internally by the walls 1, 2.

From the above it can be seen that the rocker arms carrying the uppermost one of the rollers 16, 17 are supported by their respective adjusting screws, which rest on either the brackets 3, 4 or protrusions 28. The rocker arms supporting the lowermost one of the rollers 16, 17, on the other hand, rest with the end adjacent the roller in contact with the least eccentric point of a corresponding pair of cams 29, 30. The pairs of cams 29, 30 are keyed onto rods 31, 32 which are mounted for rotation in the walls 1, 2. The rods 31, 32 protrude beyond the wall 1; onto these protruding portions are keyed radial arms 33, 34 which are interconnected by an articulated connecting rod 35. The pivots of the connecting rod 35 form, with the rotational mounting of the rods 31, 32, an articulated parallelogram by means of which synchronous movement of both the pairs of cams 29, 30 is achieved. The movement is effected by a suitable motor, viz. a pneumatic piston and cylinder unit 36 (which extends parallel to the connecting rod 35) the piston rod of which is pivotally connected to an arm 37 which is radial to and integral with the rod 31 and positioned alongside arm 33. The cylinder of the unit 36 is pivotted on a baseplate of the apparatus.

Operation of the unit 36 causes the cams 29, 30 to rotate and the cams 29, because of their shape (see FIG. 1), raise the lower roller 16 bringing it into contact with the upper roller 17 so as to grip the webs which are to be joined and which are fed between them, as will appear more clearly subsequently. When the rollers 16, 17 are positioned in superposition to the left of the rollers 7, 8, the roller 17 will be lowermost and operation of the unit 36 to rotate the cams 29, 30, will cause the cam 30 to raise the roller 17.

In order to avoid the upper roller being lifted when the lower one is pushed against it, locking means is provided; the locking means comprises obstacles by which movement of the arms is obstructed. The obstacles comprise pairs of pins 38, 39 which are threaded into respective rods 40, 41 to project radially therefrom, the rods 40,41 extending between the walls 1, 2, parallel to the shafts 5, 6 and below the rollers 7, 8. The rods 40, 41 are rotatable and on portions of them which project to the rear beyond the wall 1, are fixed two respective radial pegs 42, 43 which are interconnected by a tension spring 44 which urges them against lugs 45, 46 protruding from the wall 1.

The position of these lugs 45, 46 is chosen so that, with the pegs 42, 43 in contact with them, the tops of the pins 38, 39 are aligned with the appropriate one of the notches 18, 19 (depending on whether the rollers 16, 17 are to the left or right of the rollers 7, 8, viewing FIG. 1), in such a way as to obstruct the rotational movement of the rocker arms 14 or 15. To release the locking means, the pins 38, 39 are moved into disengaged positions by two handles **40*a*, 41*a* keyed onto the rods 40, 41 at the end portions projecting from the front of the apparatus. The rods 40, 41 are moved alternately so as to rotate either the pin 38 or the pin 39 against the return action of the spring 44. The notches 20, 21 in the edges of the rocker arms 14, 15 are simply there to avoid the tops of the pins 38, 39 interferring with the rocker arms 14, 15 which are resting on the cams 29, 30**.

FIG. 1 shows the (superposed) position which the rollers 16, 17 adopt immediately prior to splicing. A web 47 is unwinding from the reel (which is running out) and advancing in a direction A. The web 47 is guided by a roller 48 which is cantilevered on the wall 1. An eccentric roller 49, mounted on the same shaft as the roller 48 by means of a bracket 50, prevents the web 47 moving backwardly, i.e. opposite to the direction A. The web 47 travels around the roller 17 and then is fed downwardly through the nip between the rollers 7, 8. Similarly a new web 51 is fed in the direction B between a further pair of rollers 52, 53 and its leading end is positioned above the lower roller 16. In order to support the leading ends of webs, when necessary, there are two transverse tables 54, 55 which form a bridge between the walls 1, 2 and the upper surface of which is basically tangential to the lower roller.

Figure 4:
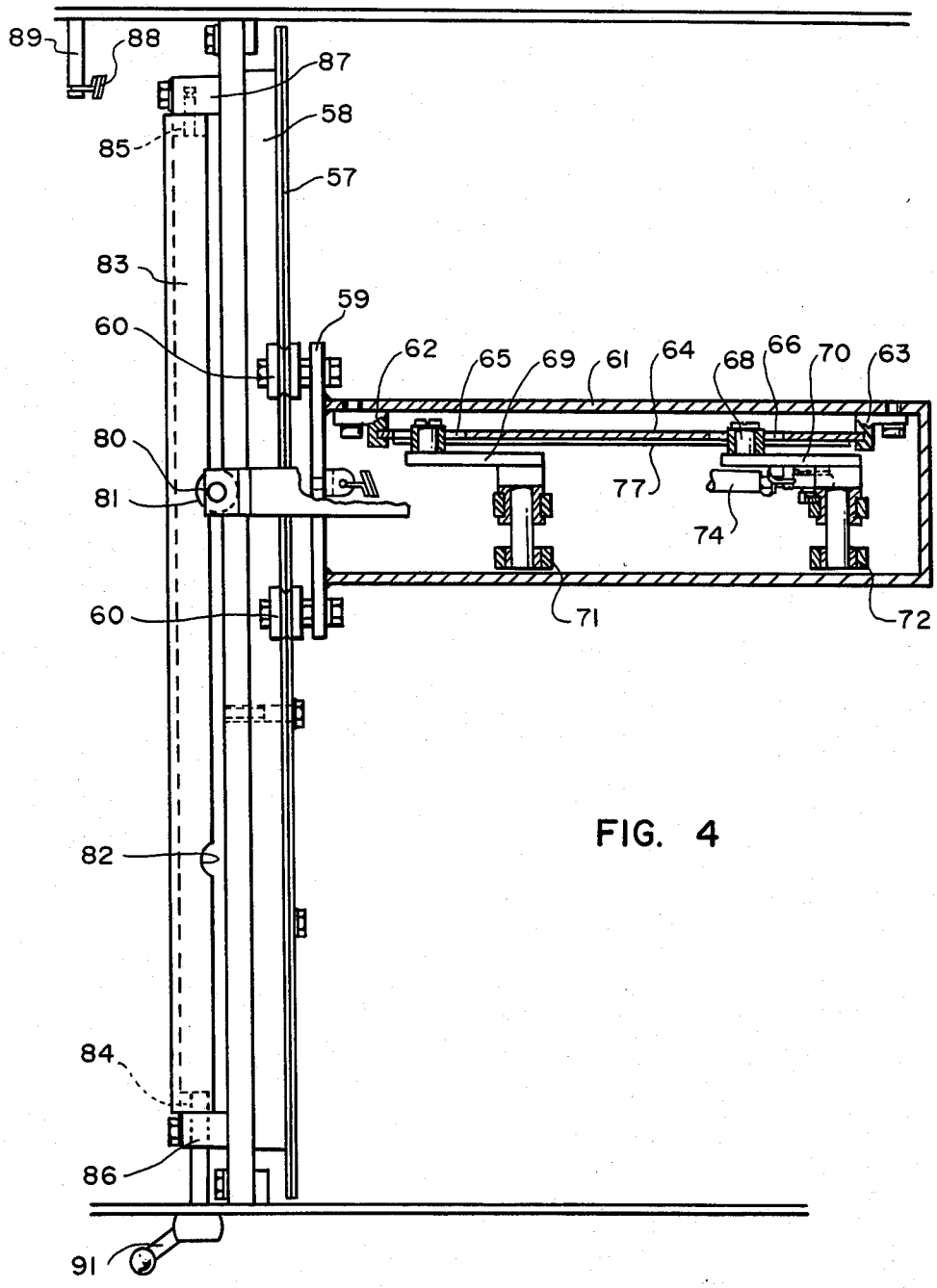
FIG. 4 is a plan view, partly in cross-section showing a cutting device of the apparatus.

In order to cut the web of a reel which has just run out at a pre-arranged position in relation to the leading end of the new web with which it is to be spliced, the apparatus comprises a cutting device 56 which is located at a level above that of the rollers 16, 17 when they are in their upper positions. This device comprises a rail 57, which is fixed horizontally to the wall 1 with a spacer 58 therebetween, the top and bottom edges of which are V-shaped (see FIGS. 3 and 4). On the rail 57 runs a carriage comprising a rectangular plate 59 in the corners of which are rotatably mounted four small wheels 60 which have grooves therearound whereby they are guided along the top and bottom edges of the rail 57. To the plate 59 is fixed a cantilevered, U-shaped bracket 61 which extends horizontally. On an internal face of the bracket 61 are positioned two guides 62, 63 which are provided with opposing grooves in which side edges of a vertical plate 64 run. In the plate 64 are located two slots 65, 66 which are elongated horizontally and occupied by pins 67, 68 which protrude from triangular elements 69, 70. These triangular elements 69, 70 provide links and are pivotted in lugs 71, 72 of a cover 73 which goes over the bracket 61.

The triangular elements 69, 70 are pivotally connected by a rod 74 to form an articulated parallelogram pivotting in the lugs 71, 72 and supporting the plate 64. To the triangular element 70 is hooked an end of a tension spring 75, the opposite end of which is hooked to a lug integral with the carriage 59. To the lug 72 mounting the triangular element 70 is fixed, by means of a shackle **70*a*, the piston rod of a pneumatic piston and cylinder unit 76, the cylinder of which is articulated to the carriage 59. The unit 76, against the return tension of the spring 75, causes the triangular elements 69, 70 to rotate which in turn causes the plate 64** to descend.

Fixed to the bottom of the plate 64 is a blade 77 which is used to cut off the web which has just run out. To oppose the thrust of the blade on the web during the cutting operation two brushes 78, 79 extend between the pairs of rocker arms 14, 15 in the vicinity of the rollers 16, 17.

The cutting device 56 can be moved manually along the rail 57 between two positions determined by a detent, viz. roller 80, which is mounted on the carriage 59 and which drops into one of two respective seats 81, 82 in an L-sectioned strip 83 which extends above and behind the top edge of the wall 1. The opposite ends of the strip 83 are fitted with two levers 84, 85 which are pivotally mounted in supports 86, 87 which are fixed onto the rear of the wall 1. The lever 85 is pivotted near its mid-point and at the lower end is hooked onto a tension spring 88 which has its opposite head hooked onto a small pin 89 which is integral with a housing 90 of the apparatus and which keeps the strip 83 in contact with the small roller 80.

The support pin of the strip 83 which passes through the support 86, protrudes from the housing 90 and to it is fixed a handle 91 with which it is possible to rotate the strip 83 against the return action of the spring 88 in order to disengage the small roller 80 from the relevant one of the seats 81, 82. It can be seen that when the strip 83 is rotated away from the small roller 80, it operates a switch 92 which keeps the unit 76 out of action in order to avoid the blade being brought into action accidentally. Completing the apparatus described is a hood 93 which is hinged to the housing 90 above the cutting device 56. The hood is in the shape of a right angle so as to close off the apparatus at the front, resting on the top edge of the wall 2.

The operation of the apparatus is described hereinafter with particular reference to FIGS. 5*a* to 5*h* of the drawings.

Figure 5A:
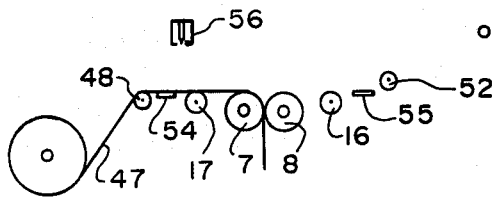
FIGS. 5*a* to 5*h* show, in diagrammatic form, various operational stages of the apparatus.

Whilst the web 47 is unwinding, the rollers 16, 17 are positioned as shown in FIG. 5*a*, that is to say one to the right and one to the left of the fixed rollers 7, 8 and both tangential to their associated tables 54, 55. The web 47, after having been guided on its way by the roller 48, proceeds horizontally over the table 54, brushing past the roller 17 and passes through the nip between the rollers 7, 8. The web is advanced by feeding mechanisms which are not shown in the drawings. The cutting device 56 is retained in the left one of its fixed positions by engagement of the roller 80 in the seat 82 of the strip 83, as required for the preceding cut. As can be seen from FIG. 5*a*, the area to the right of the rollers 7, 8 and above the roller 16, remains completely free, so that it is simple to position the leading end of the web 51 of a new reel on the roller 16 after having applied a double-sided adhesive tape 94 (see FIG. 1) to it. The positioning of the end of the new web 51 is made easier by the support given to it by the nearby table 55 and backward movement of the web is prevented by the roller 53. These preparatory operations with regard to the web 51 may be carried out throughout the time that the web 47 is unwinding; the new web 51, so positioned, is shown in FIG. 5*b*.

Before the web 47 runs out, the roller 17 is made to rotate around the fulcrum provided by the bushes 12, 13 by operating the handle 23. The roller 17, after having described an arc of a circle, ends up above the roller 16 at a given height, determined by engagement of the adjusting screws 27 with the top of the brackets 3, 4, at which, however, it is still spaced from the roller 16 so that the web 47 cannot come into contact with the adhesive tape 94.

Figure 5B:
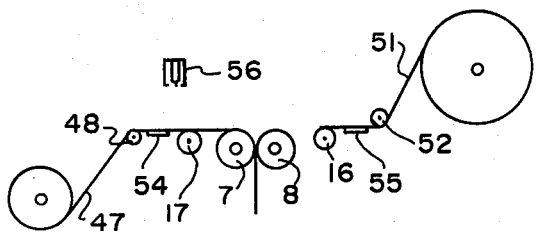
Figure 5C:
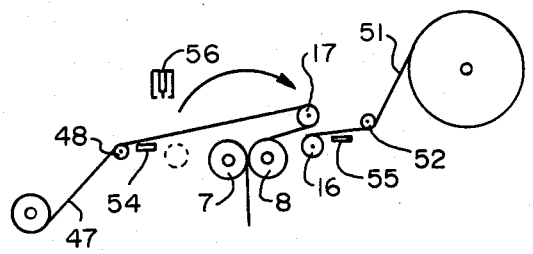
Figure 5D:
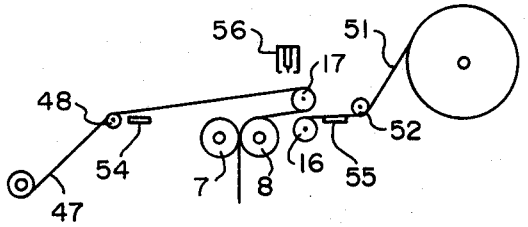
Figure 5E:
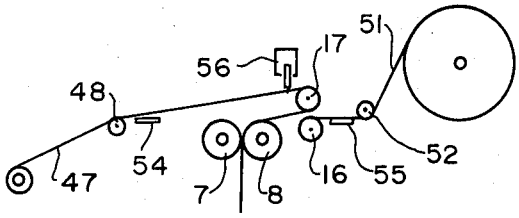
Figure 5F:
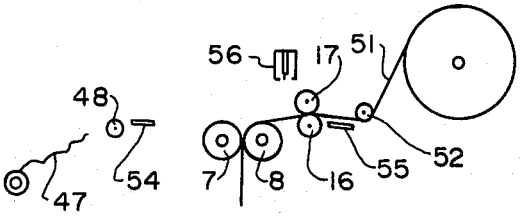
Figure 5G:
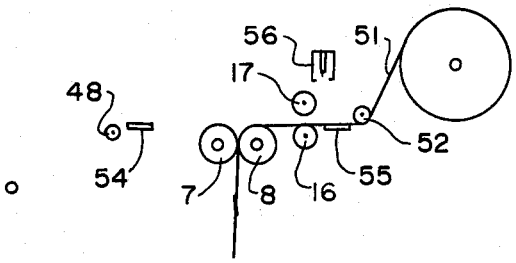

The possibility of the roller 17 swinging back towards the position in which it is shown in FIGS. 5*a* and 5*b* is eliminated by the pins 38 which, when the adjusting screws 27 come into contact with their relevant surface, engage in the notches 19 at the ends of the rocker arms 15, due to the effect of the spring 44. At this point (FIG. 5*d*) the cutting device 56 is moved into the position for cutting the web 47. By operating the handle 91 the strip 83 is made to rotate backwards, against the action of the spring 88 and, keeping the strip 83 back, the carriage 59 is moved along the rail 57, until the small roller 80 has left the seat 82. The carriage 59 is moved along the rail 57 until the small roller 80 engages the seat 81 thereby retaining the cutting device in its new position. As previously mentioned, during this phase, any accidental operation of the unit 76 is prevented by the switch 92 on which a constant pressure is maintained by the strip 83 until the small roller 80 has reached the seat 81.

Figure 5H:
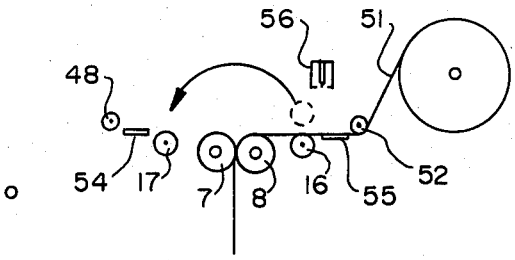

The next operations (FIG. 5*e*) consist of cutting the web 47 and carrying out the splicing process. To this end an electric contact (not shown) operates the unit 76 which, as it extends against the return action of the spring 75, causes the triangular elements 69, 70 to rotate anti-clockwise (viewing FIG. 3) causing the plate 64 and the blade 77 which is secured to it, to descend. The blade 77 chops off the web 47, continuing down into the brush 79 below (see FIG. 1). Almost at the same time as the unit 76 is operated, the unit 36 is also operated (FIG. 5*f*) which causes the cams 29, 30 to rotate. Whereas the rotation of the cams 30 does not produce any effect, the cams 29, by virtue of their shape, raise the rocker arms 14 thereby bringing the roller 16 up against roller 17 which in turn brings the leading end of the web 51 into contact with the tail of the web 47. The adhesive tape 94 brings about the splicing of the webs. At this point (FIG. 5*g*) the cutting device, which constitutes an obstacle to the swinging of the roller 17, is moved to the right of the roller 16 after the small roller 18 has been disengaged from the seat 81 in the way described above in relation to FIG. 5*d*. The roller 17 is then moved back to its starting position alongside the roller 7; to effect this, the handle 40*a* therefore is operated so as to disengage the pins 38 from the notches 19 and by operating the handle 23 the roller 17 is made to rotate into the above mentioned position alongside the roller 7 (FIG. 5*h*).

The apparatus is now in a working position which is substantially a mirror image of that shown in FIG. 5*a*, ready to carry out preparations for the next splicing of webs (from old and new reels) in accordance with the phases described above except that this next splicing operation will be carried out at the left position, with the roller 16 being the upper roller locked by the pins 39 and the roller 17 being the lower roller, raising of which to effect splicing being effected by the cams 30. Particular stress is to be laid on the fact that, as can be clearly seen from FIG. 5*b*, preparing the leading end of a new web is not hindered by the presence of moving parts and can be carried out with precision even if the reel is of considerable width. Moreover, since the adhesive tape on the leading end of the new web is not advanced as far as the area of the nip between the rollers 7, 8, the danger of it remaining stuck somewhere, thereby jeopardising the splicing itself, is avoided.

Having thus described our invention, what we claim as new and desire to secure by letters Patent of the United States is:

1. An apparatus for splicing the trailing end of an old web of a reel about to run out and the leading end of a new web of a new reel, comprising:

(a) a frame having two reels, each reel mounted on opposite sides of said frame; said reels each adapted to carry webs;

(b) a pair of generally tangential rollers each mounted on a fixed axis on said frame and between which the web is fed;

(c) a pair of opposed coaxial bushings mounted on said frame on an axis substantially tangential to the plane of said pair of tangential rollers;

(d) a pair of rocker arms pivotally mounted on said bushings and having end portions extending outwardly from said bushings;

(e) each of said pair of rocker arms having an idler roller mounted on one end portion thereof on an axis substantially tangential to the plane of said pair of tangential rollers, said idler rollers being positioned one above the other so that the upper idler roller supports the old web and the lower idler roller supports the new web;

(f) said rocker arms being pivotal together from a first position placing said idler rollers on one side of said pair of tangential rollers to a second position placing said idler rollers on the opposite side of said pair of tangential rollers so that the upper one of said idler roller and the lower one of said idler roller can support the web from the reel at either end of said frame;

(g) a pair of lock means mounted on said frame on each side of said tangential rollers, one of said lock means being engageable with an end portion of one of said rocker arms when said rocker arms are in said first position and the other of said lock means being engageable with an end portion of the other of said rocker arms when said rocker arms are in said second position to restrain upward movement of the upper one of said idler rollers;

(h) a pair of cam means pivotally mounted on said frame on each side of said pair of rollers; one of said cam means being engageable with an end portion of one of said rocker arms when said rocker arms are in said first position and the other of said cam means being engageable with an end portion of the other of said rocker arms when said rocker arms in said second position;

(i) said cam means being operable to pivot said rocker arms to raise the lower one of said idler rollers so that the new web supported thereon can be pressed against the old web on the upper one of said idler rollers.

2. Apparatus according to claim 1 comprising a cutting device for trimming the tail from the trailing end of the old web.

3. Apparatus according to claim 2 wherein the cutting device comprises a carriage which runs on a guide rail perpendicular to said pair of tangential rollers, a bracket projecting from the carriage and provided with vertical guides, and a blade mounted for movement in the guides and driven by a piston and cylinder unit on the bracket, said carriage being movable between a non-operational position when the end of a new web is being positioned on the lower idler roller and an operational position for cutting the end of the old web which has run out.

4. Apparatus according to claim 3 wherein the blade is attached to a parallel linkage supported on the aforesaid bracket and movable against resilient return means.

5. Apparatus according to claim 4 wherein the non-operational and operational positions of said carriage are determiend by engagement of a detent mounted on the carriage in appropriate seats of a strip parallel to the rail along which the carriage runs and rotatable against resilient means, and means preventing operation of the blade when the detent is disengaged from the seats.

* * * * *